US006380916B1

(12) United States Patent
Kim

(10) Patent No.: US 6,380,916 B1
(45) Date of Patent: Apr. 30, 2002

(54) COLOR ADJUSTMENT CIRCUIT FOR LIQUID CRYSTAL DISPLAY

(75) Inventor: Jin Sung Kim, Kyoungki-do (KR)

(73) Assignee: Hyundai Display Technology Inc., Kyoungki-do (KR)

( * ) Notice: Subject to any disclaimer, the term of this patent is extended or adjusted under 35 U.S.C. 154(b) by 0 days.

(21) Appl. No.: 09/294,849

(22) Filed: Apr. 20, 1999

(30) Foreign Application Priority Data

Apr. 22, 1998 (KR) ..... 98-14370

(51) Int. Cl.[7] ..... G09G 3/36
(52) U.S. Cl. ..... 345/88; 345/87; 345/98
(58) Field of Search ..... 358/80; 340/701, 340/703; 345/87, 88, 98

(56) References Cited

U.S. PATENT DOCUMENTS 4,232,311 A * 11/1980 Agneta ..... 340/703
4,689,613 A * 8/1987 Ikeda ..... 340/703
4,745,461 A * 5/1988 Shirai et al. ..... 358/21
4,789,892 A * 12/1988 Tsuzuki et al. ..... 358/80
4,845,481 A * 7/1989 Havel ..... 340/762
4,959,712 A * 9/1990 Tsuzuki et al. ..... 358/80
5,089,810 A * 2/1992 Shapiro et al. ..... 340/701
5,287,172 A * 2/1994 Lee ..... 345/150
5,369,432 A * 11/1994 Kennedy ..... 345/88
5,956,006 A * 9/1999 Sato ..... 345/88

FOREIGN PATENT DOCUMENTS

| | | |
|---|---|---|
| JP | 5061447 | 3/1993 |
| JP | 6186935 | 7/1994 |
| JP | 6343177 | 12/1994 |
| JP | 8023517 | 1/1996 |
| JP | 8154199 | 6/1996 |

* cited by examiner

*Primary Examiner*—Dennis-Doon Chow
*Assistant Examiner*—Alecia D. Nelson
(74) *Attorney, Agent, or Firm*—Ladas & Parry

(57) ABSTRACT

A color adjustment circuit in LCDs, comprising: an R data adjusting portion for externally receiving an R data of selected bits, which has a predetermined color level, for adjusting the color level of the received R data to a desirable color level and for generating the color level adjusted-R data; a G data adjusting portion for externally receiving a G data of selected bits, which has a predetermined color level, for adjusting the color level of the received G data to a desirable color level and for generating the color level adjusted-G data; and a B data adjusting portion for externally receiving a B data of selected bits, which has a predetermined color level, for adjusting the color level of the received B data to a desirable color level and for generating the color level adjusted-B data.

12 Claims, 8 Drawing Sheets

COLOR ADJUSTMENT CIRCUIT FOR LIQUID CRYSTAL DISPLAY

BACKGROUND OF THE INVENTION

This invention relates to a flat panel display device for displaying an image using digital R, G and B signal, and more particularly to a color adjustment circuit for a liquid crystal display (LCD) capable of displaying the image where the preferring color of red(R), green(G) or B(blue) colors is stressed by an user's color taste.

When image is displayed through display devices, it has tendency to prefer the picture screen that R, G or B color is stressed in an user's color taste. Accordingly, it is desired to display the image where the R color is stressed in case of preferring the R color, the G color is stressed in case of preferring the G color or the B color is stressed in case of preferring the B color in accordance with an user's taste.

In the prior art, the method for adjusting the R, G and B colors adjusts the color of the image displayed in the picture screen to a desirable color by varying the luminance according to the voltage of an backlight.

The color characteristic of a TFT-LCD is determined to the characteristics of the R, G and B data, a backlight and a color filter. A color filter should be used a finished products made by a maker.

SUMMARY OF THE INVENTION

It is an object of the present invention to provide a color adjustment circuit in a LCD capable of displaying an image by stressing the preferring color of the R, G and B colors in accordance with an user's taste.

It is an aspect of the present invention to provide a color adjustment circuit in a liquid crystal display, comprising: an R data adjusting portion for externally receiving an R data of selected bits, which has a predetermined color level, for adjusting the color level of the received R data to a desirable color level and for generating the color level adjusted-R data; a G data adjusting portion for externally receiving a G data of selected bits, which has a predetermined color level, for adjusting the color level of the received G data to a desirable color level and for generating the color level adjusted-G data; and a B data adjusting portion for externally receiving a B data of selected bits, which has a predetermined color level, for adjusting the color level of the received B data to a desirable color level and for generating the color level adjusted-B data.

The R data adjusting portion includes: a counting portion for counting a first pulse signal to select the desirable color level of the R data and for providing the selected R data and a selection signal; an add/subtraction portion for add/subtracting the received R data and the selected R data from the counting portion in accordance with the first selection signal and for providing an add/subtracted R data and a carry signal; and a data selection portion for selecting the output signal of the add/subtraction portion, a power signal and a ground signal in accordance with the carry signal and the selection signal and for providing the selected signal as the color level-adjusted R data.

The counting portion in the R data adjusting portion includes: a pulse generator for genrating the first pulse signal having a constant period; a switch for setting the desirable color level of the R data; an AND gate for generating a second pulse signal having a phase inverted to the first pulse signal as a clock a signal whenever the switch is pushed; and a counter for counting the clock signal from the AND gate to generate output signals having predetermined bits, a most significant bit being provided as the selection signal and remnant bits being provided as the selected R data to the add/subtraction portion.

The add/subtraction portion in the R data adjusting portion includes; a plurality of exclusive OR gates for carrying out 1's complement to the selected R data from the counting portion; and a plurality of adder/subtracters for receiving the externally received R data and the output signals from the exclusive OR gates, for add/subtracting the received R data and the selected R data in accordance with the selection signal bit by bit and for generating the add/subtracted R data and the carry signal.

The data selection portion in the R data adjusting portion includes a plurality of multiplexers for receiving the respective output signals from the adder/subtraction portion, the power signal and the ground signal and selecting one of them in accordance with the carry signal and the selection signal and for providing the selected one as the color level-adjusted R data.

The G data adjusting portion includes: a counting portion for counting a first pulse signal to select the desirable color level of the G data and for providing the selected G data and a selection signal; an add/subtraction portion for add/subtracting the received G data and the selected G data from the counting portion in accordance with the selection signal and for providing an add/subtracted G data and a carry signal; and a data selection portion for selecting the output signal of the add/subtraction portion, a power signal and a ground signal in accordance with the carry signal and the selection signal and for providing the selected signal as the color level-adjusted G data.

The counting portion in the G data adjusting portion includes: a pulse generator for generating the first pulse signal having a constant period; a switch for setting the desirable color level of the G data; an AND gate for generating a second pulse signal having a phase inverted to the first pulse signal as a clock signal whenever the switch is pushed; and a counter for counting the clock signal from the AND gate to generate output signals having predetermined bits, a most significant bit being provided as the selection signal and remnant bits being provided as the selected G data to the add/subtraction portion.

The add/subtraction portion in the G data adjusting portion includes; a plurality of exclusive OR gates for carrying out 1's complement to the selected G data from the counting portion; and a plurality of adder/subtracters for receiving the externally received G data and the output signals from the exclusive OR gates, for add/subtracting the received G data and the selected G data in accordance with the selection signal bit by bit and for generating the add/subtracted G data and the carry signal.

The data selection portion in the G data adjusting portion includes a plurality of multiplexers for receiving the respective output signals from the adder/subtraction portion, the power signal and the ground signal and selecting one of them in accordance with the carry signal and the selection signal and for providing the selected one as the color level-adjusted G data.

The B data adjusting portion includes: a counting portion for counting a first pulse signal to select the desirable color level of the B data and for providing the selected B data and a selection signal; an add/subtraction portion for add/subtracting the received B data and the selected B data from the counting portion in accordance with the selection signal and for providing an add/subtracted B data and a carry signal; and a data selection portion for selecting the output signal of the add/subtraction portion, a power signal and a ground signal in accordance with the carry signal and the selection signal and for providing the selected signal as the color level-adjusted B data.

The counting portion in the B data adjusting portion includes: a pulse generator for generating the first pulse signal having a constant period; a switch for setting the desirable color level of the B data; an AND gate for generating a second pulse signal having a phase inverted to the first pulse signal as a clock signal whenever the switch is pushed; and a counter for counting the clock signal from the AND gate to generate output signals having predetermined bits, a most significant bit being provided as the selection signal and remnant bits being provided as the selected B data to the add/subtraction portion.

The add/subtraction portion in the B data adjusting portion includes; a plurality of exclusive OR gates for carrying out 1's complement to the selected B data from the counting portion; and a plurality of adder/subtracters for receiving the externally received B data and the output signals from the exclusive OR gates, for add/subtracting the received B data and the selected B data in accordance with the selection signal bit by bit and for generating the add/subtracted G data and the carry signal.

The data selection portion in the R data adjusting portion includes a plurality of multiplexers for receiving the respective output signals from the adder/subtraction portion, the power signal and the ground signal and selecting one of them in accordance with the carry signal and the selection signal and for providing the selected one as the color level-adjusted B data.

DETAILED DESCRIPTION OF THE INVENTION

Figure 1:
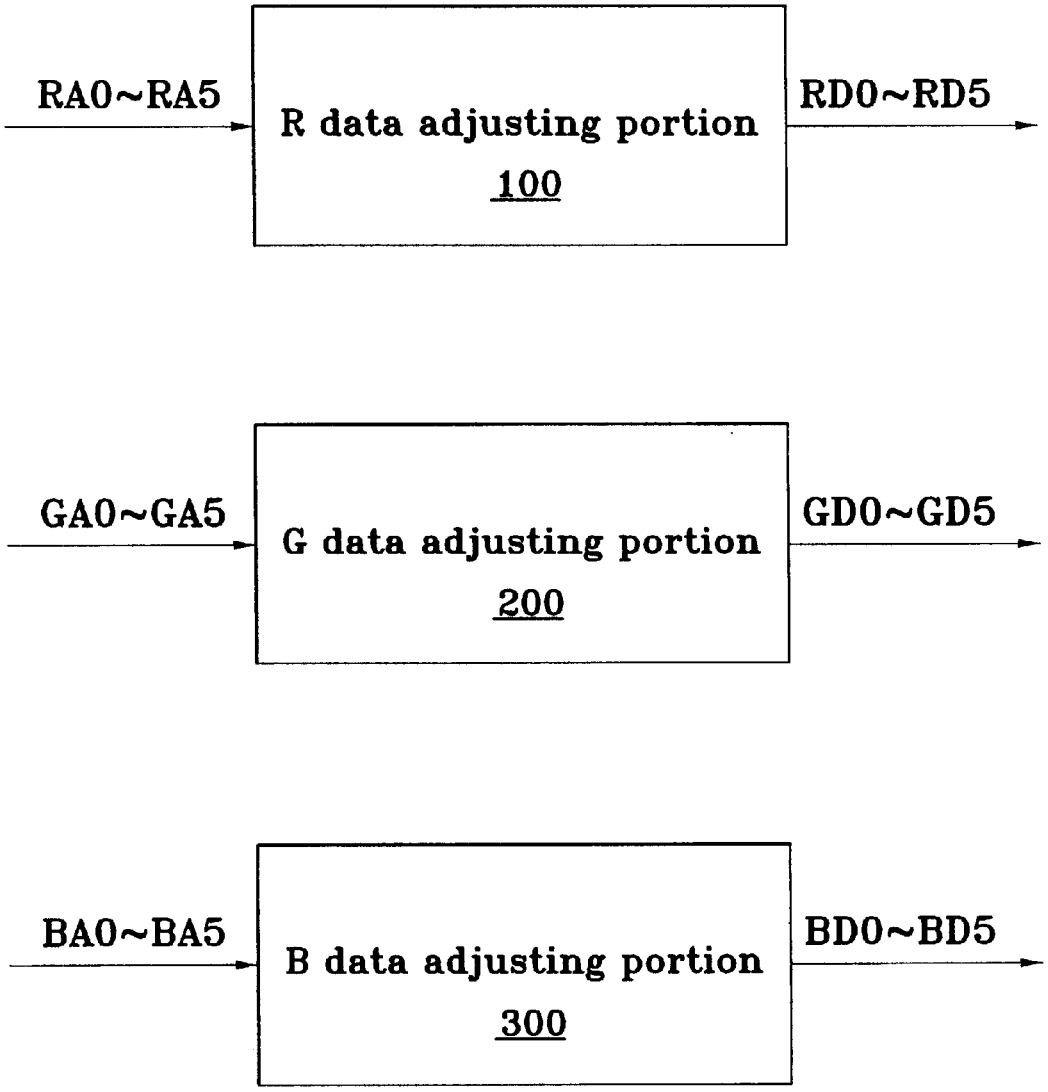
FIG. 1 is a schematic block diagram of a color adjustment circuit for a LCD in accordance with an embodiment of the present invention.
Figure 2:
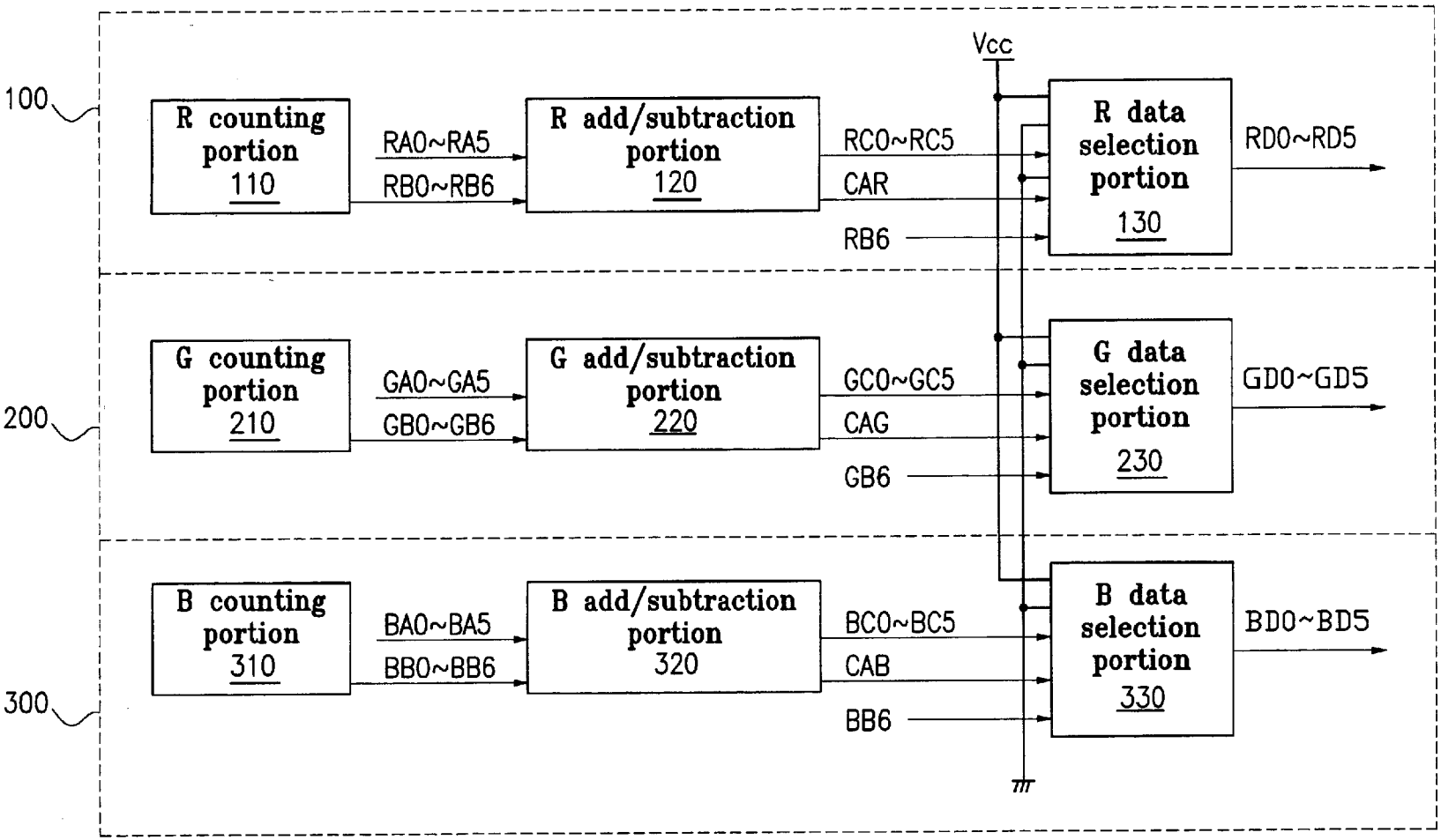
FIG. 2 is a detailed block diagram of the color adjustment circuit in FIG. 1.

FIG. 1 is a schematic block diagram of a color adjustment circuit for a LCD in accordance with an embodiment of the present invention and FIG. 2 is a detailed block diagram of the color adjustment circuit in FIG. 1. Referring to FIG. 1 and FIG. 2, the color adjustment circuit for a LCD includes an R data adjusting portion 100 receiving R data of 6 bits RA0–RA5 which is externally applied and has a predetermined color level, adjusting the color level of the received R data RA0–RA5 to a desired color level and generating the color level-adjusted R data RD0–RD5; a G data adjusting portion 200 receiving G data of 6 bits GA0–GA5 which is externally applied and has a predetermined color level, adjusting the color level of the received G data GA0–GA5 to a desired color level and generating the color level-adjusted G data GD0–GD5; and a B data adjusting portion 300 receiving B data of 6 bits BA0–BA5 which is externally applied and has a predetermined color level, adjusting the color level of the received B data BA0–BA5 to a desired color level and generating the color level-adjusted B data BD0–BD5.

The R data adjusting portions 100 includes a counting portion 110 for counting a pulse signal generated by a push button for a R color to select the desired color level of R data and providing the R data RB0–RB5 having the selected color level and a first selection signal RB6; an adder/subtracter portion 120 for receiving the externally applied R data RA0–RA5 and the selected R data RB0–RB5, carrying out add/subtraction operation between the received R data RA0–RA5 and the selected R data RB0–RB5 in accordance with the first selection signal RB6 from the counting portion 110 and providing the added/subtracted R data RC0–RC5 and a first carry signal CAR and a data selection portion 130 for receiving the R data RC0–RC5 from the adder/subtracter portion 120, a power voltage and a ground voltage, selecting one of the R data RC0–RC5, the power voltage Vcc and the ground voltage in accordance with the first selection signal RB6 from the counting portion 110 and the first carry signal CAR from the add/subtraction portion 130 and providing the selected one as the color level-adjusted R data RD0–RD5.

The G data adjusting portions 100 includes a counting portion 110 for counting a pulse signal generated by a push button for a G color to select the desired color level of G data and providing the G data GB0–GB5 having the selected color level and a second selection signal GB6; an adder/subtracter portion 120 for receiving the externally applied G data GA0–GA5 and the selected G data GB0–GB5, carrying add/subtraction operation between the received G data GA0–GA5 and the selected G data GB0–GB5 in accordance with the second selection signal GB6 from the counting portion 110 and providing the added/subtracted G data GC0–GC5 and a second carry signal CAG and a data selection portion 230 for receiving the G data GC0–GC5 from the adder/subtracter portion 220, a power voltage and a ground voltage, selecting one of the G data GC0–GC5, the power voltage Vcc and the ground voltage in accordance with the second selection signal GB6 from the counting portion 210 and the second carry signal from the add/subtraction portion 230 and providing the selected one as the color level-adjusted G data GD0–GD5.

The B data adjusting portions 300 includes a counting portion 310 for counting a pulse signal generated by a push button for a B color to select the desired color level of B data and providing the B data BB0–BB5 having the selected color level and a third selection signal BB6; an adder/subtracter portion 220 for receiving the externally applied B data BA0–BA5 and the selected B data BB0–BB5, carrying add/subtraction operation between the received B data BA0–BA5 and the selected B data BB0–BB5 in accordance to the third selection signal BB6 from the counting portion 310 and providing the added/subtracted B data BC0–BC5 and a third carry signal CAB and a data selection portion 330 for receiving the B data BC0–BC5 from the adder/subtracter portion 320, a power voltage and a ground voltage, selecting one of the B data BC0–BC5, the power voltage Vcc and the ground voltage in accordance with the third selection signal BB6 from the counting portion 310 and the third carry signal CAB from the add/subtraction portion 330 and providing the selected one as the color level-adjusted B data BD0–BD5.

Figure 3:
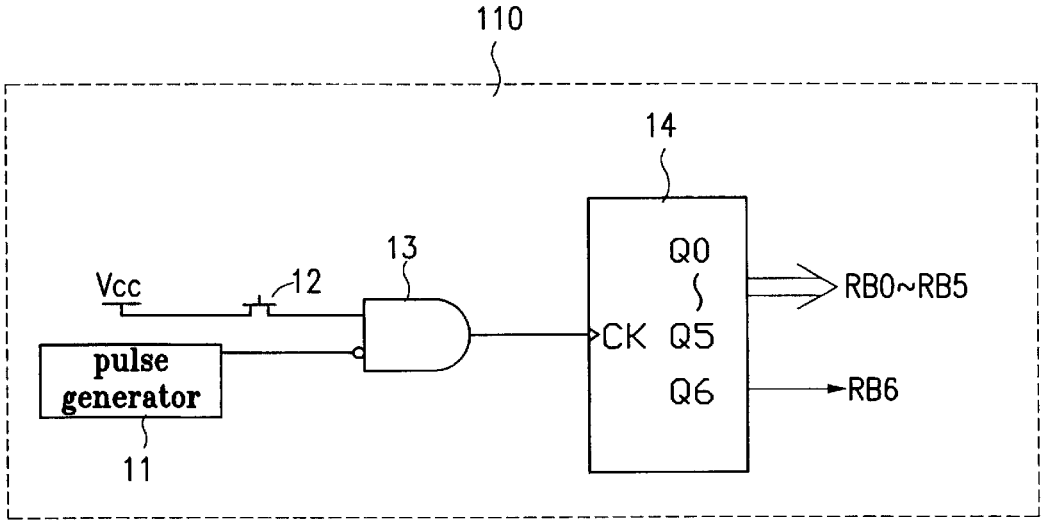
FIG. 3 is a detailed circuit diagram of a counting portion of an R data adjusting portion in the color adjustment circuit for a LCD.

FIG. 3 is a detailed circuit diagram of the counting portion 110 in the R data adjusting portion 100 in FIG. 2. Referring to FIG. 3, the counting portion 110 includes a pulse generator 11 for generating a first pulse having a predetermined period, for example 1 Hz, the push button 12R for setting the desired color level of the R data, an AND gate 12 for generating a second pulse signal having a phase inverted to the first pulse signal as a clock signal, whenever the push button 12R is pushed by an user and a 7-bit counter 14 for counting the second pulse signal which is applied to its clock terminal CK from the AND gate 12 and providing 7-bit output signals RB0–RB6. The most significant bit(MSB) RB6 of 7-bit output signals RB0–RB6 is applied to the adder/subtracter 120 and data selection portion 130 as the selection signal and the remnant 6 bits are applied to the adder/subtracter portion 120.

An user pushes the push button 12R so as to set the desired color level of the R data. If an user pushes the push button 12R at regular intervals, the counter 14 counts the second pulse signal from the AND gate 13 and generates the output signals of 7-bits which is increased by one whenever the push button is pushed. At this time, if the push button 12R is continuously pushing by an user, the clock signal is continuously provided to a clock terminal of the counter 14 and the counter 14 counts the clock signal with rapid to provide the output signal of 7-bits.

The MSB RB6 of the output signal is provided to the data selection portion 130 as a first selection signal for data selection as well as to the adder/subtracter portion 120 as a first selection signal for add/subtraction selection signal and the remnant 6 bits RB0–RB5 are provided to the adder/subtracter portion 120 as a R data for add/subtraction with the externally received 6bit R data RA0–RA5.

At this time, add operation or subtraction operation of the adder/subtracter portion 120 is selected by the first selection signal which is the MSB RB6 of the counter 14. If the MSB RB6 is "0", that is the output signal RB6–RB0 of 7-bits is 0000000–0111111, the adder/subtracter portion 120 carries out the add operation of the remnant 6 bit output signal RB5–RB0. On the other hand, If the MSB RB6 is "1", that is the output signal RB6–RB0 of 7-bits is 1000000–1111111, the adder/subtracter portion 120 carries out the subtraction operation of the remnant 6 bit output signal RB5–RB0.

In the embodiment of the present invention, only the counting portion 110 of the R data adjusting portion 100 is illustrated. However the counting portions 210 and 310 of the G data adjusting portion 200 and the B data adjusting portion 300 have the same construction as that of the counting portion 110 of the R data adjusting portion 100. R, G and B data are disparately adjusted by selectively carrying out add/subtraction operation so that three push buttons for R, G and B data is needed.

Figure 4:
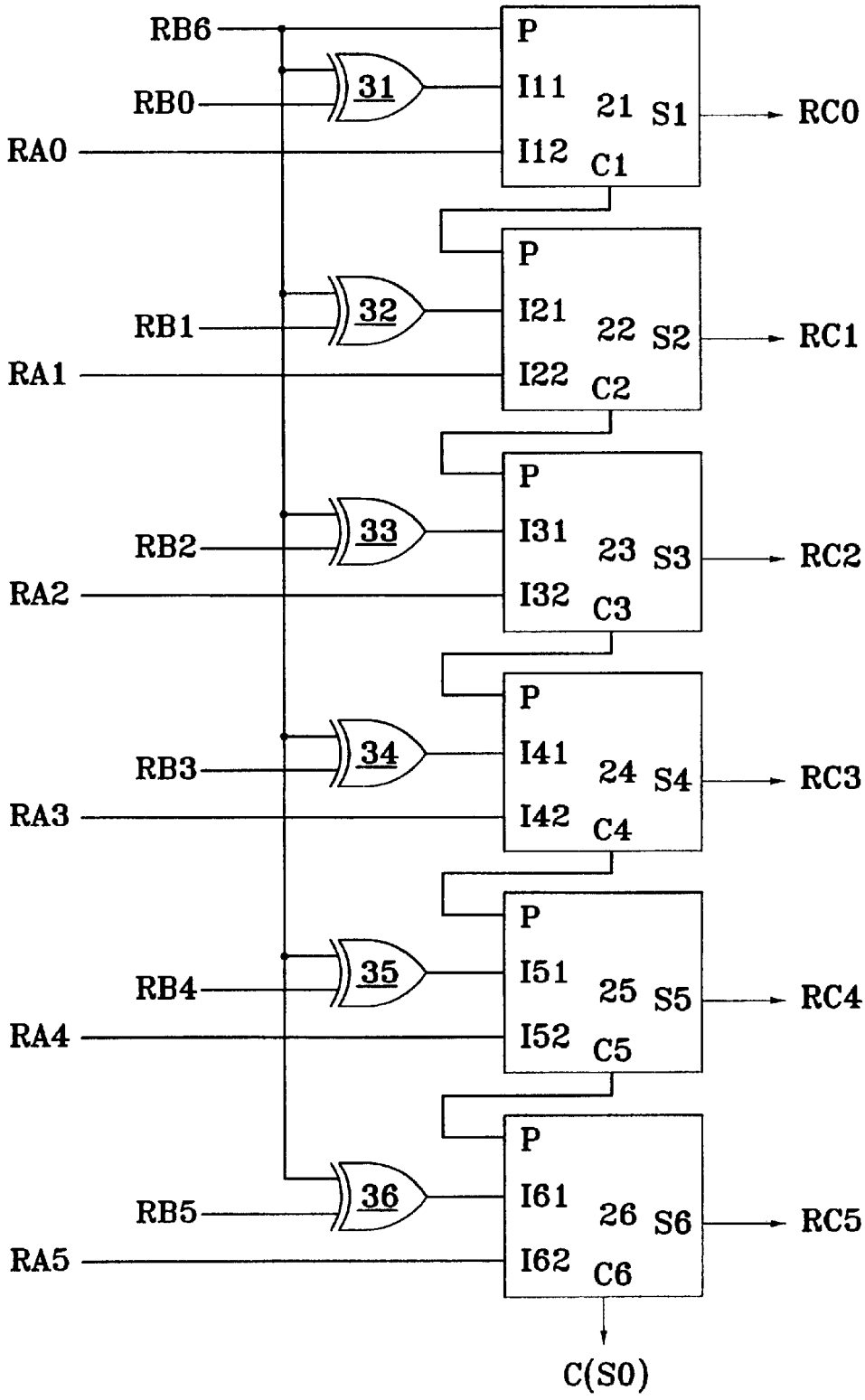
FIG. 4 is a detailed circuit diagram of an add/subtraction portion of an R data adjusting portion in the color adjustment circuit for a LCD.

FIG. 4 is a detailed circuit diagram of the adder/subtracter portion 120. Referring to FIG. 4, the adder/subtracter portion 120 includes adder/subtracters 21–26 for receiving the 6-bit R data RA0–RA5 which is externally applied and the 6-bit R data RB0–RB5 which is applied from the counting portion 110 and carrying out add/subtraction operation of the 6 bit R data RB0–RB5 selected through the counting portion 110 and the externally received R data RA0–RA5 in accordance with the first selection signal RB6 for add/subtraction operation selection and exclusive OR gates 31–36 for carrying out 1's compilement to the 6 bit R data RB0–RB5 selected from the counting portion 110.

In the embodiment, the adder/subtracters 21–26 may be embodied with full adders or with carry-look ahead adders. In the adder/subtracter portion 120, the adder/subtracters 21–26 carries out subtraction operation bit by bit in case the MSB RB6 of the output signal from the counter 14 is "1". The exclusive OR gates 31–36 receives the MSB RB6 of the output signal from the counter 14 as one input signal. The exclusive OR gates 31–36 receives the 6-bit R data RB0–RB5 as the other input signal, respectively so that they provide the 1's compliment value to the selected R data RB0–RB5.

Accordingly, the adder/subtraction portion 120 adds the output signals of the exclusive OR gates 31–36 having the 1's complement value to the selected R data RB0–RB5 and the externally received R data RA0–RA5 through the adder/subtracters 21–26 bit by bit and outputs the output signal RC0–RC5 having 2's complement value, so that the subtraction operation is carried out.

On the contrary, in case the MSB RB6 of the output signals from the counter 14 is "0", the exclusive OR gates receives the MSB RB6 of "1" as one input signal so that the 5 bits signal RB0–RB5 for R data are provided to the adder/subtracters 21–26, respectively as it is through the exclusive OR gates 31–36. Therefore, the adder/subtracters 21–26 adds the externally received R data RA0–RA5 and the selected R data RB0–RB5 to output the output signal RC0–RC5.

In the embodiment of the present invention, in case an user dislikes the redish color and one diminishes the R data compared to the G and B data, an user pushes the push button 12R. The counter 14 in the counting portion 110 counts the clock signal to set the color level of the R data. The adder/subtracter portion 120 subtracts the R data RA0–RA5 from the R data RB0–RB5 from the counter 14 through the adder/subtracters 21–26. If the color level of the externally received R data RA0–RA5 is smaller than that of the selected R data RB0–RB5, the adder/subtracters 21–26 generates the positive R data RC0–RC5 and does not generates the first carry signal as a result of the subtraction operation.

If the color level of the externally received R data RA0–RA5 is larger than that level of the selected R data RB0–RB5, the adder/subtracters 21–26 generates the negative R data RC0–RC5 and the first carry signal as a result of the subtraction operation. This means that the R data RA0–RA5 of R, G and B data which are externally applied is completely eliminated. That is, it means that the color level of R data which is to be displayed is set to the minimum value.

On the other hand, an user prefers the redish color and one stresses the R data of R, G and B data compared to the G and B data, one pushes the push button 12R so as to set the desired color level of R data. Then counting portion 110 set the desired color level of the R data through the counter 14. The adder/subtracter portion 120 adds the externally received R data RA0–RA5 to the selected R data RB0–RB5. The carry C generated in the add operation means the occurrence of overflow. If the carry C is not generated in add operation, overflow is not occurred and it means that the R data is stressed by the selected R data from the counting portion 110.

Figure 5:
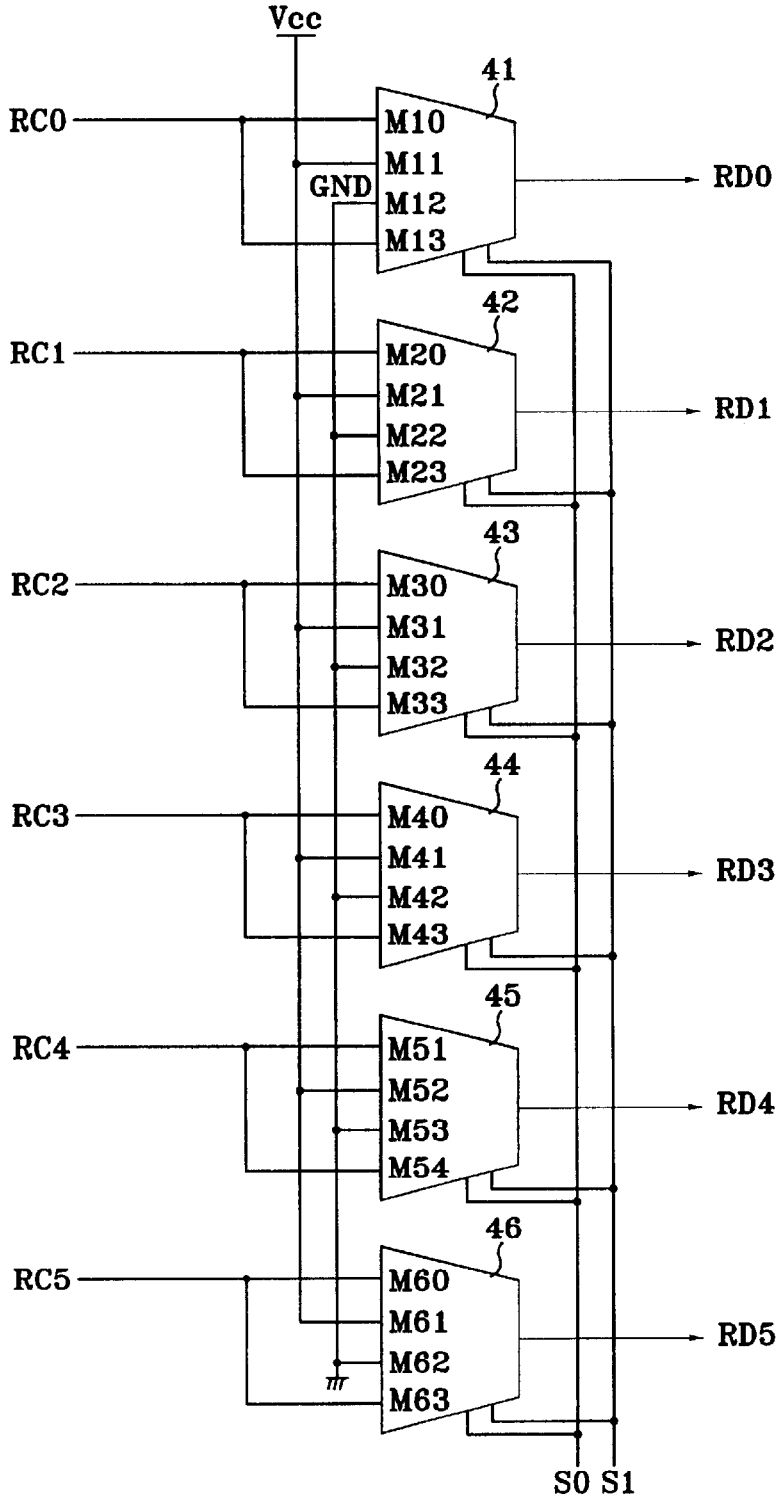
FIG. 5 is a detailed circuit diagram of a data selection portion of an R data adjusting portion in the color adjustment circuit for a LCD.

FIG. 5 a detailed circuit diagram of the data selection portion 130 in the R data adjusting portion 100. Referring to FIG. 5, the data selection portion 130 includes a plurality of multiplexor 41–46 which receives the output signals RC0–RC5 from the adder/subtracters 21–26 of the adder/subtracter portion 120, the power voltage Vcc of high state and the ground voltage of low state GND as four input signals M0–M3 and selects one of the four input signals in accordance with the MSB output signal RB6 from the counter 14 and the first carry signal CAR from the add/subtracter portion 120 which are data selection signals S0 and S1.

At this time, the output signals RC0–RC5 from the adder/subtracters 21–26 are simultaneously provided to multiplxers 41–46 as a first input signal M10–M60 and a fourth input signal M14–M64 of the four input signals M10–M13 through M60–M63. If the carry C is not generated through the adder/subtracter portion 120 in the subtraction operation, that is if the first selection signal RB6 from the counter 14 is "1" and the first carry signal CAR is "0", the color level of the selected R data RB0–RB5 from the counting portion 110 which are provided as the subtrahend input signals I11–I61 of the adder/subtracters 21–26 of the adder/subtracter portion 120 is larger than that of the received R data RA0–RA5 which are provided as the minuend input signals I12–I62 of the adder/subtracters 21–26 of the adder/subtracter portion 120.

In this case, the selection signals S0S1 of the multiplexers 21–26 becomes "10" and the multiplexers 21–26 selects the third input signals M13–M36 from the four input signals M10–M60 through M14–M64, which is the ground signal GND of low state. If the ground signal represents 6-bit binary data, it becomes 000000. Therefore, the data selection portion 130 provides the R data RD0–RD5 of "000000" which its color level is adjusted by an user.

At this time, because the output signal of the adder/subtracter portion 120 has a negative value, the color level of the R data RD0–RD5 should be adjusted to a minimum value. Substantially, because the R, G and B data are 6-bit signals, the R, G and B data have the color level of 0–63. Therefore, the minimum level of the R data is "0" so that the R data adjusting portion 100 generates the 6-bit R data RD0–RD5.

In case the carry is generated in the subtraction operation, that is the first selection signal is "1" and the first carry signal is "1", the color level of the selected R data RB0–RB5 from the counting portion 110 which are subtrahend input signals I11–I61 of the add/subtracter 21–26 in the adder/subtracter portion 120 is smaller than that of the received R data RA0–RA5 which are minuend input signals I12–I62. At this time, the selection signals S0S1 of the multiplexers 21–26 are "11" and the multiplexes 21–26 select the fourth input signals M14–M64 of the four input signals M10–M60 through M14–M64, respectively. Therefore, the data selection portion 130 provides the R data RD0–RD5 of 6-bits so that the image where the R color is diminished by the desired color level of the R data RB0–RB5 from the counting portion 110 from the received color level of the R data RA0–RA5, is displayed on a picture screen.

On the contrary, if the carry is generated in the add operation, that is the first selection signal RB6 is "0" and the first carry signal is "1", the selection signals S0S1 of the multiplexers 21–26 become "01". The multiplexers 21–26 select the second input signals M12–M62 of the four input signals M10–M60 through M14–M64, respectively and the data selection portion 130 provides "111111" as the adjusted R data RD0–RD5 of 6-bits so as to stress the R color at its maximum.

If the carry is not generated in the add operation, that is the first selection signal RB6 is "0" and the first carry signal is "0", the selection signals S0S1 of the multiplexers 21–26 become "00". The multiplexers select the first input signals M11–M61 of the four input signals M10–M60 through M14–M64. That is the multiplexers 21–26 selects the output signals RC0–RC5 from the adder/subtracter 21–26 of the adder/subtracter portion 120, respectively and the data selection portion 130 provides the color-level adjusted R data RD0–RD5 where the received R data RA0–RA5 is added to the selected R data RB0–RB5.

Figure 6:
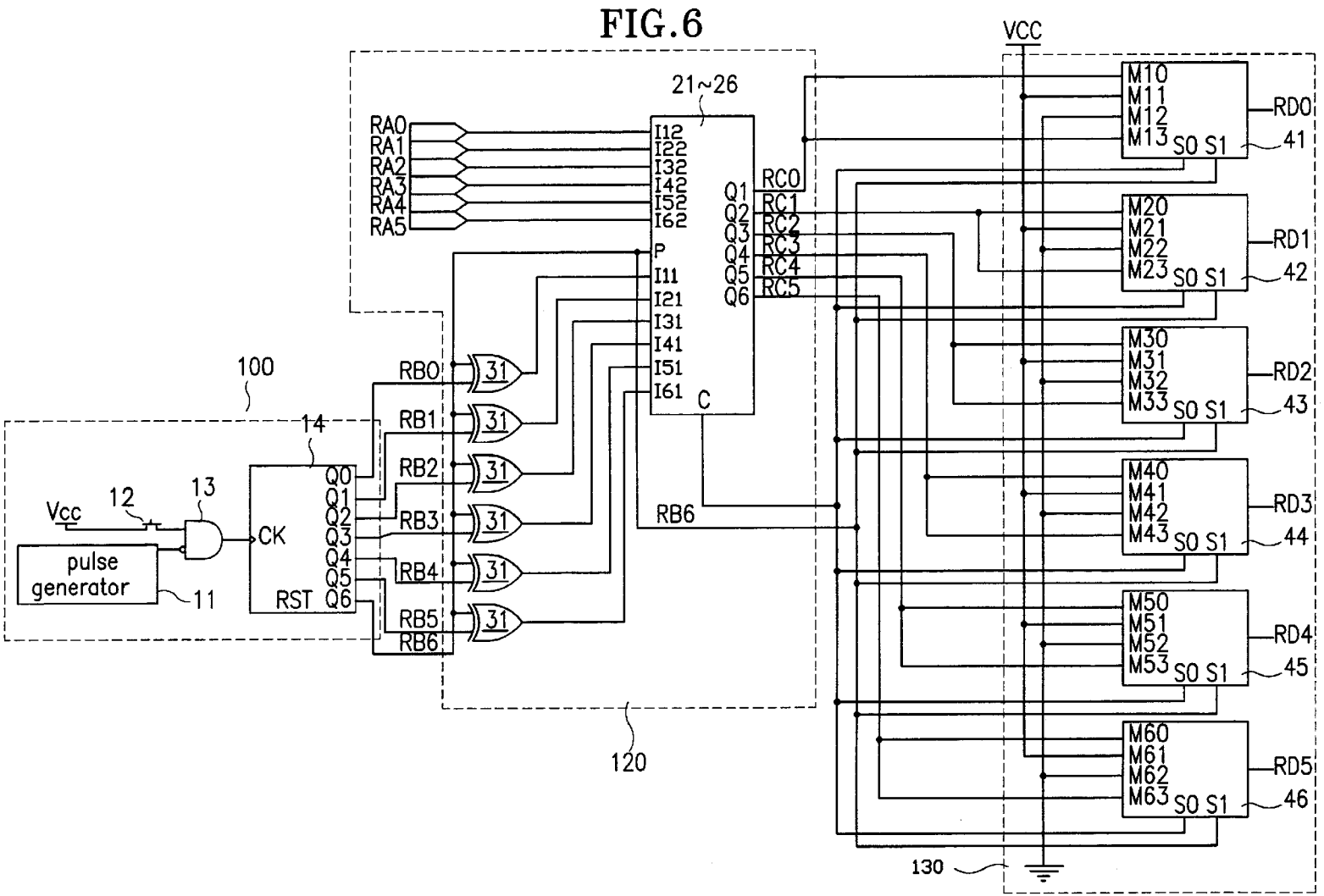
FIG. 6 is a detailed circuit diagram of the R data adjusting portion in the color adjustment circuit for a LCD.

In FIG. 6, the entire circuit diagram of the R data adjusting portion 100 as the above described is illustrated. Herein, the G data adjusting portion 200 and the B data adjusting portion 300 are not described in detail, but the G data adjusting portion 200 and the B data adjusting portion 300 have the same construction as the R data adjusting portion 100. The G data adjusting portion 200 and the B data adjusting portion 300 adjust the color levels of the G and B colors using the push button 12G and 12B.

The present invention discloses the color adjustment circuit for adjusting the R, G and B data of 6-bits but it may embody a color adjustment circuit for adjusting R, G and B data of 8-bits. So as to embody the color adjustment circuit for R, G and B of 8-bits, a 9-bit counter is used instead of the 7-bit counter in the counting portions 110, 210 and 310, and a 8-bit adder/subtracter is used instead of the 6-bit adder/subtracter in the adder/subtracter portion 120, 220 and 320, and a 8-bit multiplxer is used instead of the 6-bit multiplexer in the data selection portion 130, 230 and 330.

Furthermore, in case of adjusting the R, G and data of 6-bits, a kind of $2^6 \times 2^6 \times 2^6 = 256K$ color are adjustable. However, it may be adjustable to a line of $2^8 \times 2^8 \times 2^8 = 16M$ color in case of R, G and G data of 8-bits so that the natural color can be expressed.

The operation of the color adjustment circuit in an embodiment of the present invention will be described as follows.

when the push buttons 12R, 12G and 12B are not pushed, the counting portions 110, 210 and 310 in the R, G and B adjusting portion 100, 200 and 300 does not operate. That is, if the push buttons 12R, 12G and 12B are pushed, the clock signal is not supplied to the clock terminal of the counter 14 through the AND gate 13 so that the counter 14 does not carry out the counting operation. Accordingly, the counters 14 of the counting portions 110, 210 and 310 in the R, G and B data adjusting portions 100, 200 and 300 provide all "0000000" as the output signals RB0–RB6, GB0–GB6 and BB0–BB6 of R, G and B data. The adder/subtracters 21–26 of the adder/subtracter portions 120, 220 and 320 provide the externally received R, G and B data RA0–RA5, GA0–GA5 and BA0–BA5 as the output signals RC0–RC5, GC0–GC5 and BC0–BC5 as it is. The adder/subtracter portion 120, 220 and 320 provide the R, G and B data RC0–RC5, GC0–GC5 and BC0–BC5 to the data selection portions 130, 230 and 330, respectively.

At this time, because the selection signal S1 is "1", the multiplexers 41–46 select the output signals from the adder/subtracters 21–26 which are the first input signals or the third input signals of the four input signals regardless of the selection signal S0. Accordingly, the R, G and B data adjusting portions 100, 200 and 300 provides the R, G and B data RC0–RC5, GC0–GC5 and BC0–BC5 as the color level-adjusted R, G and B data.

As above described, if the push buttons are not pushed, that is in case an user does not want to adjust the color, the image on the basis of the externally received R, G and B data RA0–RA5, GA0–GA5 and BA0–GA5 is displayed.

Next, in case of adjusting the color, it sets the desired color level of the R, G and B colors, for example the color level of the R data using the push button 12R. Whenever the pushbutton 12R is pushed at regular intervals, the counter 14 counts the clock signal received from the pulse generator 11 through the AND gate 13 to set the desired color level of R data. If the push button is continuously pushed for a constant time, the counters fast counts the clock signal so that it sets the desired color level with rapid. The output signals RB0–RB6 of the counter portions having the desired color level selected through the counting portion 110 using the push button 12R and the first selection signal RB6 are provided to the adder/subtracter portion 120.

The adder/subtracters 21–26 receives the R data RB0–RB5 as input signals for add/subtraction respectively and the MSB signal selection signal for selecting add/subtraction operation. The adder/subtracters 21–26 are add or subtract the externally received R data RA0–RA5 and the selected R data RB0–RB5 of the counting portion 110 in accordance with the first selection signal RB6. In case the first selection signal is "1", the adder/subtracters 21–26 subtract the selected R data RB0–RB5 from the R data RA0–RA5 to decrease the color level of the R data RA0–RA5 externally received. That is, in subtraction operation, the add/subtraction portion 110 carries out 1's complement to the selected R data RB0–RB5 through the exclusive OR gates 31–36 and then adds the 1's complement value to the R data RA0–RA5, thereby carrying out the 2's complement to accomplish the subtraction operation.

At this time, if the color level of the R data RA0–RA5 is smaller than that of the R data RB0–RB5, because the negative value of he R color is not exist, the counting portion 100 provides the smallest value "000001". For example, if the R data RA0–RA5 is "000000" and the R data RB0–RB5 is "111111", the 1's complement value to the R data "111111" obtained through the exclusive OR gate 31–36 becomes "000001". Therefore, the 1's complement value "000001" to the R data RB0–RB5 is added to the R data RA0–RA5 "000001" so that the counting portion 100 provides the output signals of the R data RC0–RC5"000010".

The output signals RC0–RC5 are provided to the multiplexers 41–46 of the data selection portion 140, respectively. By the selection signals S0S1 of "10", the multiplexers 41–46 respectively select the ground signal of a low state signal received as the third input signal M12–M62 without the output signals of the add/subtraction portion 120 and provide "000000" as the adjusted-R data TD0–RD5.

In case the MSB output signal RB6 is "0", the adder/subtracters 21–26 respectively add the R data RB0–RB5 from the counting portion 110 to the R data RA0–RA5 to stress the R color. At this time, if the carry signal is generated as a result of add operation, the selection signals S0S1 become "01" so that the multiplexers 41–46 respectively selects the power voltage of a high state signal as the second input signals M11–M61 without the output signals of the add/subtraction portion 120 to provide the output signals "111111" as the adjusted R data RD0–RD5. If overflow is generated, that is if the output signals of the add/subtraction portion 120 is "1000000", it adjusts the color level of R color to the maximum 63 level($2^6$=64).

If it adjusts the G and B colors like the manner as above described, when the R, G and B data are respectively 6-bits, the color adjustment circuit of the present invention represents the 64 color levels of o to 63 to the R, G and B colors, respectively. When the R, G and B data are respectively 6-bits, the color adjustment circuit of the present invention represents the 256 color levels of o to 255 to the R, G and B colors, respectively. Accordingly, the color adjustment circuit is capable of changing the R, G and B data which are externally received into the desired R, G and B data to change the color characteristics of the image which is displayed through a plat panel display such as a TFT-LCD using the digital R, G and B data. For example, when "111111", "111111" and "111111" are received as the 6-bit R, G and B data, if adjusts the R, G and B data to "111111", "111110" and "111110" using the color adjustment circuit, the picture screen is changed into the redish-white color from the original white color. Furthermore, the present invention can set the desirable R, G and B data through push buttons and then store the set R, G B data through the counters and change the digital R, G and B data through the add/subtracters.

Figure 7:
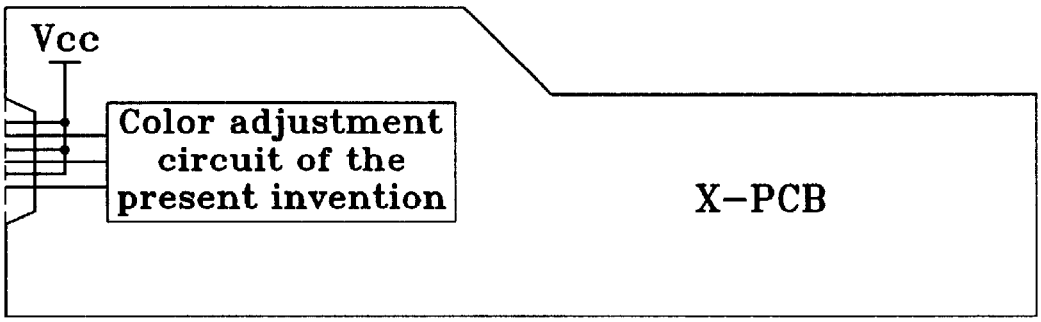
FIG. 7 is an example of installing the color adjustment circuit of the present invention into a printed circuit board (PCB) for data driving.
Figure 8A:
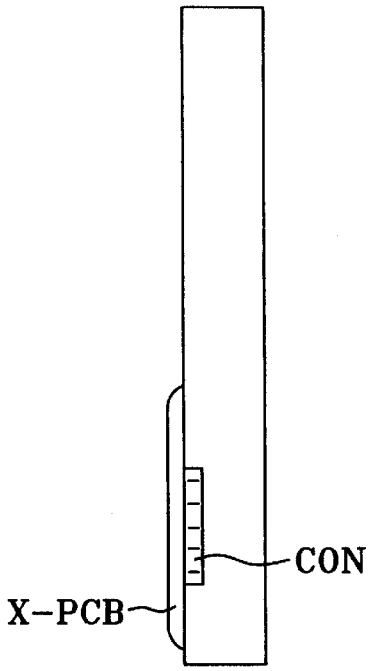
FIG. 8*a* and FIG. 8*b* are a side view and a rear view of a thin film transistor(TFT) LCD where the color adjustment circuit of the present invention is installed.
Figure 8B:
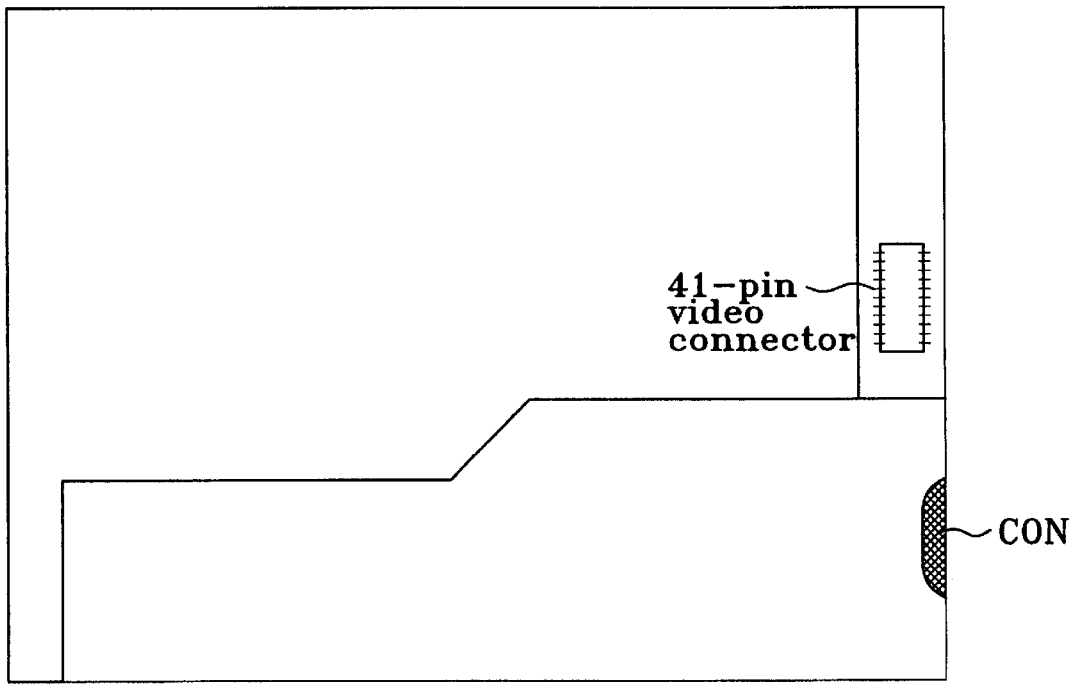

FIG. 7 is an example that the color adjustment circuit of the present invention is mounted on the PCB X-PCB for data drive. FIG. 7 shows the connection between the push buttons 12R, 12G and 12B for adjusting the R, G and B data and the color adjustment circuit of the present invention. FIG. 8*a* and FIG. 8*b* are a side view and a rear view, which are examples that the color adjustment circuit of the present invention is mounted on the TFT-LCD. The color adjustment circuit is positioned in the side of the TFT-LCD under the consideration of the thickness of the TFT-LCD and connects to the push buttons 12R, 12G and 12B for R, G and B using a female connecter CON.

According to the present invention, it can versatilely adjust the color to the desirable color in a plat panel display which receives the R, G and B data to display, so that it corresponds to users having different taste and it provides the versatility of the plat panel display by offering the function as a selection option.

If it installs the color adjusting terminals in the outside of the TFT-LCD, an user can certainly adjust the terminals to provide utility in use.

While the invention has been particularly shown and described with respect to preferred embodiment thereof, it will be understood by those skilled in the art that various changes in form and details may be made therein without departing from the spirit and the scope of the invention as defined by the following claims.

What is claimed is:

1. A color adjustment circuit in a liquid crystal display, comprising:

a counting portion for selecting R data according to a switch controlling the color of R data and for generating the selected R data and selection signals;

an adding/subtracting portion for adding/subtracting the R data received from the counting portion and from the outside according to the selection signals and for generating the added/subtracted R data and carry signals; and a data selection portion for selecting one from R data received from the adding/subtracting portion, power voltage and ground voltage according to the selection signals from the counting portion and carry signals from the adding/subtracting portion and for outputting the selected data as adjusted R data, wherein the counting portion further comprises a pulse generating portion for generating a pulse with a predetermined period;

a switch portion for selecting desirable R data;

an AND gate portion for phase inverting and outputting the pulse received from the pulse generating portion whenever the switch is operated; and a bit counter portion for counting the pulse received from the AND gate and for generating output signals with predetermined bits, a most significant bit being outputted as the selection signals to the adding/subtracting portion and the data selection portion and the remaining bits being outputted as the selected R data to the adding/subtracting portion.

2. The color adjustment circuit as claimed in claim 1, wherein the adding/subtracting portion further comprises:

a bit adding/subtracting a portion for adding/subtracting the R data received from outside and from the bit counter portion according to the selection signals and for generating added/subtracted R data and carry signals; and an exclusive OR gate portion for outputting 1's complement of R data received from the counting portion to the bit adding/subtracting portion according to the selection signals received from the counting portion.

3. The color adjustment circuit as claimed in claim 1, wherein the data selection portion comprises a plurality of multiplexers.

4. A color adjustment circuit in a liquid crystal display, comprising:

a counting portion for selecting G data according to a switch controlling the color of G data and for generating the selected G data and selection signals;

an adding/subtracting portion for adding/subtracting the G data received from the counting portion and from the outside according to the selection signals and for generating the added/subtracted G data and carry signals; and a data selection portion for selecting one from a group comprising G data received from the adding/subtracting portion, power voltage and ground voltage according to the selection signals from the counting portion and carry signals from the adding/subtracting portion and for outputting the selected data as adjusted G data, wherein the counting portion comprises a pulse generating portion for generating a pulse with a predetermined period;

a switch portion for selecting desirable G data;

an AND gate portion for phase inverting and outputting the pulse generated from the pulse generating portion whenever the switch is operated; and a bit counter portion for counting the pulse received from the AND gate and for generating output signals with predetermined bits, a most significant bit being outputted as the selection signals to the adding/subtracting portion and the data selection portion and the remaining bits being outputted as the selected G data to the adding/subtracting portion.

5. The color adjustment circuit as claimed in claim 4, wherein the adding/subtracting portion comprises:

a bit adding/subtracting portion for adding/subtracting the G data received from outside and from the bit counter portion according to the selection signals and for generating added/subtracted G data and carry signals; and an exclusive OR gate portion for outputting 1's complement of G data received from the counting portion to the bit adding/subtracting portion according to the selection signals from the counting portion.

6. The color adjustment circuit as claimed in claim 4, wherein the data selection portion comprises a plurality of multiplexers.

7. A color adjustment circuit in a liquid crystal display, comprising:

a counting portion for selecting B data according to a switch controlling the color of B data and for generating the selected B data and selection signals;

an adding/subtracting portion for adding/subtracting the B data received from the counting portion and from the outside according to the selection signals and for generating the added/subtracted B data and carry signals; and a data selection portion for selecting one from a group comprising B data received from the adding/subtracting portion, power voltage and ground voltage according to the selection signals from the counting portion and carry signals from the adding/subtracting portion and for outputting the selected data as adjusted B data, wherein the counting portion comprises a pulse generating portion for generating a pulse with a predetermined period;

a switch portion for selecting desirable B data;

an AND gate portion for phase inverting and outputting the pulse generated from the pulse generating portion whenever the switch is operated; and a bit counter portion for counting the pulse received from the AND gate and for generating output signals with predetermined bits, a most significant bit being outputted as the selection signals to the adding/subtracting portion and the data selection portion and the remaining bits being outputted as the selected B data to the adding/subtracting portion.

8. The color adjustment circuit as claimed in claim 7, wherein the adding/subtracting portion comprises:

a bit adding/subtracting portion for adding/subtracting the B data received from outside and from the bit counter portion according to the selection signals and for generating added/subtracted B data and carry signals; and an exclusive OR gate portion for outputting 1's complement of B data received from the counting portion to the bit adding/subtracting portion according to the selection signals from the counting portion.

9. The color adjustment circuit as claimed in claim 7, wherein the data selection portion comprises a plurality of multiplexers.

10. A color adjustment circuit in a liquid crystal display, comprising:

a counting portion for selecting R, G and B data according to a switch controlling the color of R, G and B data and for generating the selected R ,G and B data and selection signals;

an adding/subtracting portion for adding/subtracting the R,G and B data received from the counting portion and from the outside according to the selection signals and for generating the added/subtracted R, G and B data and carry signals; and a data selection portion for selecting one from a group comprising R, G and B data received from the adding/subtracting portion, power voltage and ground voltage according to the selection signals from the counting portion and carry signals from the adding/subtracting portion and for outputting the selected data as adjusted R, G and B data, wherein the counting portion comprises a pulse generating portion for generating a pulse with a predetermined period;

a switch portion for selecting desirable R, G and B data;

an AND gate portion for phase inverting and outputting the pulse generated from the pulse generating portion whenever the switch is operated; and a bit counter portion for counting the pulse received from the AND gate and for generating output signals with predetermined bits, a most significant bit being outputted as the selection signals to the adding/subtracting portion and the data selection portion and the remaining bits being outputted as the selected R, G and B data to the adding/subtracting portion.

11. The color adjustment circuit as claimed in claim 10, wherein the adding/subtracting portion comprises:

a bit adding/subtracting portion for adding/subtracting the R, G and B data received from outside and from the bit counter portion according to the selection signals and for generating added/subtracted R, G and B data and carry signals; and an exclusive OR gate portion for outputting 1's complement of R, G and B data received from the counting portion to the bit adding/subtracting portion according to the selection signals from the counting portion.

12. The color adjustment circuit as claimed in claim 10, wherein the data selection portion comprises a plurality of multiplexers.

* * * * *